United States Patent [19]

Saur et al.

[11] 4,389,629

[45] Jun. 21, 1983

[54] ELECTRICAL SWITCH WITH A THERMOSTATIC WORKING ELEMENT AS THE ACTUATING ELEMENT, AND A SWITCH ELEMENT IN THE FORM OF A MICROSWITCH

[75] Inventors: Roland Saur, Stuttgart; Manfred Kurz, Ditzingen, both of Fed. Rep. of Germany

[73] Assignee: Behr-Thomson Dehnstoffregler GmbH, Fed. Rep. of Germany

[21] Appl. No.: 349,815

[22] Filed: Feb. 18, 1982

[30] Foreign Application Priority Data

Mar. 11, 1981 [DE] Fed. Rep. of Germany ..... 3109133

[51] Int. Cl.[3] ..... H01H 71/18

[52] U.S. Cl. ..... 337/126; 337/312; 337/315

[58] Field of Search ..... 337/114, 115, 118, 123, 337/126, 139, 306, 312, 314, 315

[56] References Cited

U.S. PATENT DOCUMENTS

| | | | |
|---|---|---|---|
| 3,131,269 | 4/1964 | Asakawa | 337/139 |
| 3,192,436 | 6/1965 | Jewart | 337/139 X |
| 3,204,066 | 8/1965 | Gordon, Jr. | 337/139 X |

*Primary Examiner*—George Harris
*Attorney, Agent, or Firm*—Craig & Burns

[57] ABSTRACT

An electrical switch with a thermostatic working element as the actuating element and with a switch element designed as a microswitch. In order to achieve optimal utilization of space and small structural size, the contact support of the working contact of the microswitch, looking at the microswitch in a top view, is mounted laterally-displaced and next to a contact tongue of the microswitch.

20 Claims, 8 Drawing Figures

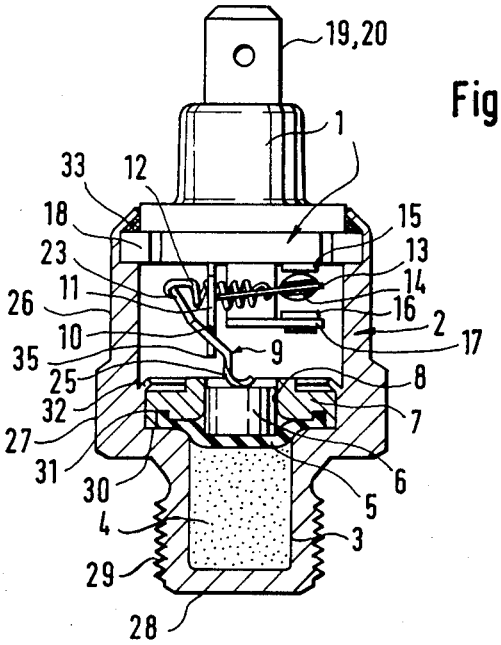
Fig. 1
Fig. 2
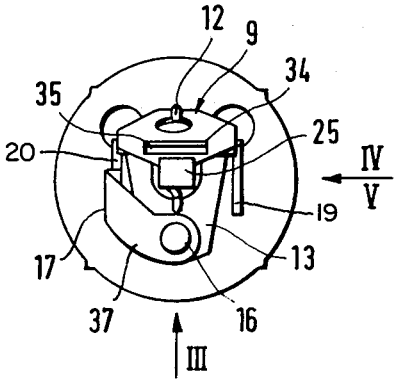
Fig. 3
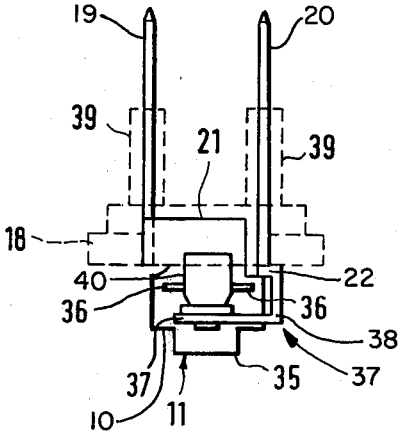

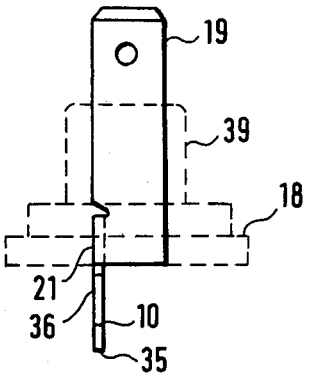
Fig. 4
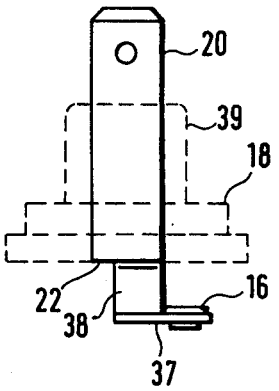
Fig. 5
Fig. 6
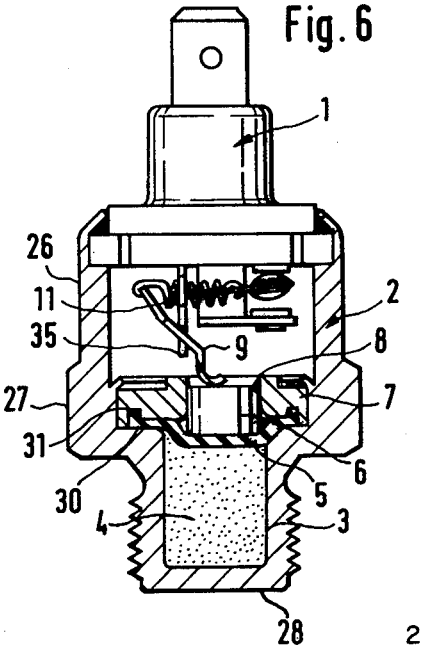
Fig. 7
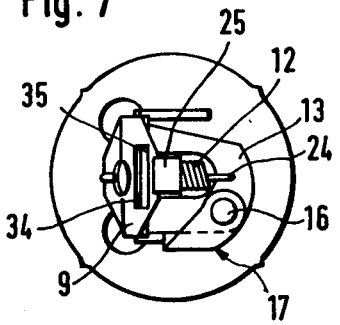
Fig. 8
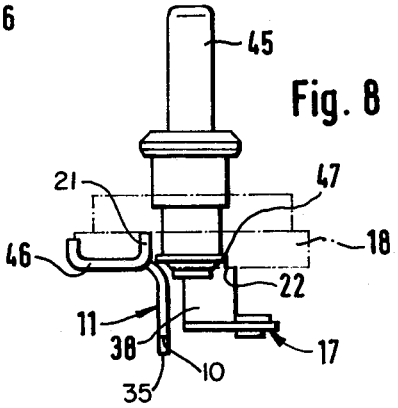

ELECTRICAL SWITCH WITH A THERMOSTATIC WORKING ELEMENT AS THE ACTUATING ELEMENT, AND A SWITCH ELEMENT IN THE FORM OF A MICROSWITCH

BACKGROUND AND SUMMARY OF THE INVENTION

The invention relates to an electrical switch with a thermostatic working element as an actuating element, and with a switch element designed as a microswitch, said elements being mounted in a one-piece metal housing with a round cross section, open on one side, said housing having a recess in its bottom area to accept a substance, especially wax, which expands when heated, said recess being covered by a rubber-elastic membrane, upon which membrane a working piston made of an insulating material, especially plastic, which is displaceable as a function of an expansion of the material, is mounted, said piston being guided in a fixed guide part which holds the membrane and comprises an axial bore, said piston being located opposite one end of a rocker of the microswitch, said rocker being aligned in an output position at an angle to the displacement direction of the working piston, said rocket being mounted on a support, and pivotable about an axis running at right angles to the displacement direction of the working piston, said rocker having its other end engaged by an extension spring serving as a restoring means for the working piston, said spring being attached to a contact tongue, said tongue being aligned essentially at right angles to the displacement direction of the piston and being mounted pivotably on the support, said tongue bearing a contact, said contact being located opposite a normally closed (NC) contact on one side and opposite a normally open (NO) contact on the other side, said contact being retained by a contact support, whereby a circular plate made of an insulating material, especially plastic, serves as a closure for the open side of the housing, said plate receiving the NC contact as well as the contact support of the NO contact and the support, and through which the electrical leads to the support and/or the contact carrier are fed to the exterior.

The known switches of the type recited hereinabove (German Pat. No. 2,444,931) are used primarily in the construction of motor vehicles and are used particularly for turning on the cooling fan of the engine cooling system when a certain engine temperature or coolant temperature is reached. In particular, the fact that the extension spring of the microswitch also serves as a restoring means for the working piston has made it possible to simplify the design and thereby considerably reduce the structural dimensions and the cost as well. Hence, switches of this type have already been used in many applications instead of switches which use a bimetallic strip as the switching element, especially since the switches with the thermostatic working element are much more reliable and exhibit higher operational reliability.

Known electrical switches with a bimetallic switch element, however, still have the advantage over known electrical switches with a thermostatic working element and a microswitch in that they are smaller and in some aspects can also be manufactured less espensively. Tests have shown that it is not possible to decrease the size of the known switch (German Pat. No. 24 44 931) by reducing its scale, largely because the space required for installing the microswitch cannot be significantly reduced.

Thus, a principal object of the invention is to design an electrical switch of the type recited hereinabove in such fashion that smaller dimensions are made possible, so that the amount of materials to be installed, and consequently the material cost and price, can be reduced accordingly, while retaining the basic principle thereof. This object is achieved in accordance with the present invention by virtue of the fact that the contact support of the NO contact, looking at the plate in the top view, is disposed laterally next to the contact tongue and mounted on the plate, displaced toward its center.

The invention is also based on the fact that a considerable limitation upon the dimensions of the microswitch that can be achieved results from the fact that the structural length of the extension spring cannot be reduced beyond a certain size for manufacturing reasons and also because of the necessary overtravel. The displaced arrangement of the contact support of the NO contact in accordance with the present invention, however, provides additional structural space precisely in the axial direction of the extension spring, so that the microswitch in particular can be made smaller.

One advantageous embodiment of the invention provides for the support and the contact support to be inserted in the plate and brought out of the latter as flat prongs, whereby the part of the contact support which forms the prongs, looking at the plate in a top view, is rotated 90° relative to the support. This ensures that the prongs are readily accessible for connection.

In order reliably to anchor the support in the plate against the extension spring force, which serves as a restoring means, provision is also made for the support to be inserted in a recess in the plate by a rectilinear extension. In order to permit an advantageous electrical connection to the support, provision is also made for the part which serves as a prong and penetrates the plate to be connected to the side of the support and rotated 90° thereto. This ensures that, despite the small dimensions, the two prongs, which are parallel to each other, will be readily accessible.

In another embodiment of the invention, provision is made for the microswitch to be provided with an outwardly projecting center contact (instead of two flat prongs), to which the contact support of the NO contact is connected, said support being riveted, with the projection which is located on the inside of the plate, to the center contact inserted into the plate. Additionally, the support has a projection which is inserted into the plate and a projection which lies on the inside of the plate, the latter projection extending outward as far as the edge of the plate and being connected in a conducting fashion with the housing.

In order further to reduce the space required for installation of the microswitch, one advantageous embodiment of the invention provides for the arm of the rocker, which the extension spring engages, to be bent in the direction of the support which projects perpendicularly from the plate. This permits reducing the space required for the rocker arm to swivel in the lateral direction.

In order either to permit an extension spring to have a greater length or further to reduce the structural dimensions, a further embodiment of the invention provides for the housing to have a first cylindrical part to accept the microswitch, against which a middle part, which has tool-application areas externally, especially an external hexagon, and accepts the guide part of the working piston internally, abuts, followed by an end part with inner and outer diameters that are smaller, said end part being provided with an external thread and having an internal recess for the substance which expands when heated. Thus, despite the transition to a relatively small thread, a sufficient volume is made available for the substance which expands when heated, and consequently the axial height of the housing can be made smaller on the whole.

In order to provide for the overtravel of the working piston which is required in practice because of the admissible temperature increases, despite the small dimensions, i.e., the travel which occurs after the switching has taken place, it is advantageous for the diameter of the working piston to be about ⅔ of the diameter of the recess for the substance which expands when heated.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 shows an electrical switch according to a first embodiment of the invention, whose housing is sectioned in the axial direction;

FIG. 2 is a view of the part of the microswitch mounted in the housing, viewed in an axial direction from below, i.e., in the displacement direction of the working piston;

FIG. 3 is a partial view of the microswitch, looking in the directon of arrow III in FIG. 2 after turning the microswitch in the upright position;

FIG. 4 is a partial view showing a first part of the microswitch, looking in the direction of arrow IV in FIG. 2;

FIG. 5 is a partial view showing a second part of the microswitch, looking in the direction of arrow V in FIG. 2;

FIG. 6 is another embodiment of an electrical switch according to the invention, with the housing sectioned axially;

FIG. 7 is a view of a modified switch, looking in the displacement direction of the working piston, with a longer extension spring; and FIG. 8 is a partial view of an embodiment of a switch according to the invention, with a center contact.

DETAILED DESCRIPTION OF THE PREFERRED EMBODIMENTS

The electrical switch in FIG. 1 is shown enlarged approximately on a scale of 2:1 relative to its actual size. It is composed of a combination of a microswitch 1 and a thermostatic working element, said element being mounted in a housing 2. The onepiece housing 2, preferably made of brass, comprises a first cylindrical part 26, in which the individual elements of microswitch 1 are mounted. A middle part 27, which forms an external hexagon, abuts this first cylindrical part 26. An end part 28 is mounted next in sequence on middle part 27, said part having a smaller diameter and being provided with an external thread 29. End part 28 comprises a closed bottom and forms a cylindrical recess 3 into which a substance 4, especially wax, which expands when heated, is introduced, said substance being provided with additives, if desired, and referred to as the expanding substance. Recess 3 is sealed by a rubber-elastic membrane 5, made of plastic, said membrane resting on a surface 30 of the housing 2 which has a cross-sectional expansion in size in the vicinity of middle part 27. Membrane 5 is held in place by a disk-shaped guide part 7. This disk-shaped guide part 7 comprises an annular groove 31, into which an annular bead of membrane 5 is fitted. Guide part 7 is dimensioned so that it tensions diaphragm 5 at its boundary area with slight elastic deformation. Guide part 7 is secured in the vicinity of middle part 27 of housing 2 by an edge 32 which is trimmed and crimped.

Guide part 7 comprises a bore 8, coaxial to the central longitudinal axis of the housing, said bore serving to guide a working piston 6, said piston abutting diaphragm 5. In this embodiment, working piston 6 is a smooth cylindrical part without any projections. In order to provide sufficient axial guide length for piston 6, disk-shaped guide part 7 is provided with a projection which surrounds axial bore 8.

Microswitch 1 comprises a circular plate 18 which is fitted into an open stepped edge of first part 26 of the housing. Plate 18, in turn, is stepped externally, whereby an O-ring 33 is placed on this step. Elastic deformation of this O-ring is achieved by crimping the outer edge of first part 26 of housing 2, so that sealing, as well as retention of plate 18, is achieved.

Microswitch 1 also comprise a rocker 9, having one, bent or ball-shaped, end 25 abutting the end of working piston 6 which faces the microswitch. Rocker 9 is disposed so that the cylindrically bent or ball-shaped end 25, in the initial position shown, rests centrally upon working piston 6, i.e., in the axis of housing 2. Rocker 9 has an opening 34 which fits on a projection 35 of a support 11, that projects from plate 18 perpendicularly to the interior of the housing, so as to abut shoulders 10 of support 11 on both sides of opening 34 with the result that support 11 forms an axis of rotation for the rocker which runs diagonally with respect to the displacement direction of working piston 6 (relative to the lengthwise axis of the housing).

The end of a compression spring 12 is attached to a second arm 23 of rocker 9, which is bent toward support 11. The other end of spring 12 is attached to a contact tongue 13. Contact tongue 13 is U-shaped, and surrounds extension spring 12 with its two legs. The ends of the two legs are sharpened, in the form of blades, and abut in notches 36 formed in support 11, so that the notches form a pivot axis for contact tongue 13 and the tongue is disposed essentially at right angles to the displacement direction of working piston 6. Contact tongue 13 comprises a contact 14 which projects beyond extension spring 12, said contact abutting an NC (normally closed) contact 15, mounted on plate 18, in the initial position shown. A NO (normally open) contact 16 is located on the other side of contact 14 of contact tongue 13, said contact 16 being supported by a contact support 17 that is mounted on plate 18.

Contact tongue 13, extension spring 12, and rocker 9, and/or the articulation point of extension spring 12 on arm 23 of rocker 9, are so designed that, in the original position shown, the extension spring engages contact tongue 13 with a force component directed toward plate 18, so that said tongue is held in place against NC contact 15. Pivoting rocker 9 changes the direction of action of extension spring 12 in such fashion that, after it passes a neutral middle position, it exerts a force component on contact tongue 13, which then is directed away from plate 18 and against NO contact 16. This produces a snapping effect for the microswitch. Extension spring 12 is pretensioned in such fasnion that the microswitch can be assembled in the initial position shown and forms a module, whereby the edges of opening 34 of rocker 9 are tensioned against stop 35 of support 11.

In order to gain installation space in the direction in which contact tongue 13 extends, contact support 17 is given a special shape formed with an arm 37, which runs parallel to plate 18, to the end of which arm NO contact 16 is riveted. This arm 37 (FIGS. 2 and 3) merges with a part 38 which is directed perpendicularly to plate 18. Part 38 penetrates laterally into plate 18 at one side of contact tongue 13, and is guided outward through plate 18 as a flat prong 20. While flat prong 20 runs symmetrically with respect to a plane which passes through the middle of plate 18, the part 38, which projects from the plate, is stepped slightly. A bent projection 22 is provided between part 38 and the part that forms flat prong 20, said projection 22 forming a stop which limits the insertion of contact support 17 into plate 18. Prong 20 is partially surrounded by a projection 39 of plate 18.

A second prong 19 is made integral with support 11 (FIGS. 3 and 4). Support 11 is provided with a stop 21 that is a rectilinear extension, said stop being inserted into a recess in plate 18. The depth of the recess in plate 18 determines the exact position of support 11 and consequently that of prong 19 as well. The part of support 11 which forms flat prong 19 adjoins projection 21 laterally, but is rotated by 90° with respect to support 11 and stop 21. Additionally, like flat prong 20, prong 19 is partially surrounded by a projection 39 of plate 18. Since the part of contact support 17 which forms prong 20 is likewise rotated by 90° relative to support 11, the two prongs 21 lie in mutually parallel planes. Support 11 is provided with an opening 40 (FIG. 3) through which extension spring 12 is guided.

The parts which form prongs 19 and 20 are extended through corresponding recesses in plate 18 and clamped in place. During assembly, a hardening adhesive is added as well, which both secures prongs 19 and 20, and provides a tight seal.

In the embodiment shown in FIG. 1, the maximum travel of the working piston 6 is delimited by stop 35 of support 11, against which working piston 6 strikes. In order to adapt this maximum piston travel to the necessary temperatures and consequent overtravels without enlarging the housing, the diameter of working piston 6 is dimensioned so that it amounts to approximately two-thirds of the diameter of recess 3. If greater overtravel is desired, i.e., higher temperatures, a provision can be made such that working piston 6 is stepped on the end facing rocker 9 in such fashion that it can travel past stop 35 on support 11. It is also possible to provide the working piston 6 with a recess in this area, but this then assumes that working piston 6 is secured against rotation. This can be simply accomplished by providing the end of the working piston, which faces the end 25 of rocker 9, with a transverse groove adapted to the width of this end, so that rocker 9 forms a protection against rotation for the piston.

It is also possible to provide a working piston 6 with a smaller diameter, whereby the axial bore 8 of guide part 7 then, likewise, has a correspondingly smaller diameter. When the diameter is so small that the axial bore comes to rest in the pivot area of end 25 of rocker 9, guide part 7 can be provided with a slot which permits unimpeded passage of end 25 of rocker 9, without the guidance of working piston 6 being significantly affected adversely thereby.

In order to permit greater overtravel, it is also possible to dispose working piston 6 off-center with respect to the housing axis (FIG. 6). The degree to which the axis of working piston 6 is off center from the housing axis is then selected so that working piston 6 can reliably slide past stop 35 on support 11.

In order to permit use of a longer extension spring 12 than that used in the embodiments shown in FIGS. 1 and 6, it is also possible to dispose the contact of contact tongue 13 and the NO contact 16 of contact support 17, as well as the NC contact 15, not on an extension of the extension axis of spring 12, but laterally thereto, as shown in FIG. 4. The articulation point 24 of extension spring 12 on contact tongue 13 then is located laterally next to the contact of contact tongue 13, NO contact 16 and the NC contact 15 (compare FIGS. 2 and 7). This displaced arrangement of the contacts with respect to the axial direction of extension spring 12 also makes it possible to further shorten microswitch 1 while retaining the lengths of extension springs 12, as shown in FIGS. 1 and 6, whereby space is saved in the direction of extension of spring 12, which is required in the embodiment shown in FIGS. 1 to 6 for mounting the contact. The contacts are then no longer disposed in the vicinity of the transverse rib of the U-shaped contact tongue 13, but in the vicinity of one of the legs.

A still further reduction of the structural dimensions of the electrical switch is possible when the laterally shifted contacts (FIG. 7) are used in conjunction with an off-center arrangement of working piston 6 (FIG. 6), especially as regards the diameter of first part 26. A modification of the embodiment shown in FIGS. 1 to 5 then permits the manufacture of a switch with a center contact 45 in the form of a cylindrical pin (instead of the two flat prongs 19, 20), while using the same design of the electrical switch as regards housing 2 and microswitch 1 (FIG. 8). In this case, provision is made for an arm 47, running parallel to plate 18, to abut part 38 of contact support 17 in the vicinity of stop projection 22, said arm then being riveted to middle contact 45, inserted in plate 18 and advantageously cemented thereto as well. In this case, support 11 is modified in such a fashion that prong 19 is eliminated. Beginning at projection 21, for example in the vicinity of recess 40, a tab or tongue or projection 46 is provided which extends as far as the edge of plate 18 and comes into contact with metal housing 2. Thus, tab 46 is a ground contact which serves as the other electrical connection to the switching part along with center contact 45. It is advantageous in this connection for parts 46, 47 of contact support 7 and support 11, running parallel to the base plate, to be placed in recesses, so that exact position determination is always ensured during assembly. FIG. 8 is a view taken from the same direction as shown in FIG. 1 and, with the exception of the abovenoted changes, the FIG. 8 embodiment otherwise corresponds to that shown in FIG. 1, rocker 9, spring 12, contact arm 13 and the like having been omitted from the view of FIG. 8 simply to facilitate illustration of the differences in construction.

While I have shown and described various embodiments in accordance with the present invention, it is understood that the same is not limited thereto, but is susceptible of numerous changes and modifications as known to those skilled in the art and I, therefore, do not wish to be limited to the details shown and described herein, but intend to cover all such changes and modifications as are encompassed by the scope of the appended claims.

I claim:

1. Electrical switch with a thermostatic actuating element and with a microswitch element, said microswitch element being mounted in a one-piece metal housing that has a round cross section and is open at one end, said housing having a recess in an opposite, bottom, end; a substance which expands when heated, being located in said recess and being covered by a rubber-elastic membrane; a guide part having an axial bore being mounted so as to hold said membrane to said housing; a working piston made of an insulating material being located upon said membrane in a manner displaceable as a result of an expansion of said substance, said piston being guided in said axial bore of the guide part; a rocker pivotably mounted on a rocker support so as to pivot about an axis which runs at right angles to the displacement direction of the working piston, said rocker having one end engageable by an end of said piston facing away from said membrane and having an arm on an opposite end to which an extension spring, which serves as a restoring means for the working piston, is attached, said spring also being attached to a contact tongue that is pivotably supported against the rocker support, said tongue being directed essentially at right angles to the displacement direction of the piston and bearing a contact which faces a normally closed (NC) contact on one side and a normally open (NO) contact on an opposite side, and which is held in place by a contact support; and a circular plate, made of an insulating material, sealing the open end of the housing, said plate carrying the NC contact, a contact support carrying the NO contact and the rocker arm support, and through which electrical leads from at least one of the rocker and NO contact supports is guided to the outside of the housing; characterized by the fact that the NO contact support, viewed in the displacement direction of said piston, is disposed laterally next to said contact tongue and is displaced relative to the middle of said plate.

2. Switch according to claim 1, wherein the rocker support and the NO contact support each have a part that extends through the plate and projects out thereof, exteriorly of the housing, as a flat prong, the part of the rocker support which forms a prong having a major axially-extending surface which is rotated by 90° relative to a major axially-extending surface of an interiorly-projecting part of the rocker support to which said rocker is mounted and upon which said contact arm bears.

3. Switch according to claim 2, wherein a stop formed as a rectilinear extension of said interiorly-projecting part of the rocker support is received in a recess in the plate.

4. Switch according to claim 3, wherein the part of the rocker support which projects as a flat prong laterally adjoins said stop.

5. Switch according to claim 4, wherein interiorly-projecting parts of at least one of said supports is unitarily formed with its part that projects exteriorly as a flat prong of a stamped and bent component.

6. Switch according to claim 2 or 5, wherein the part of the NO contact support which projects as a flat prong is interconnected with an inwardly-projecting part thereof by means of a bent stop.

7. Switch according to claim 1, wherein the microswitch is provided with a centrally located, axially-outwardly projecting middle contact, against which the NO contact support abuts, said NO contact support being riveted to said middle contact so as to have a stop projection of the NO contact support resting on the inside of said plate, the middle contact being inserted through the plate, and said rocker support being constructed with an interiorly-axially projecting part and a radially-directed projection which rests on the inside of said plate, said projection extending outward as far as the edge of the plate and forming a conducting connection with the housing.

8. Switch according to claim 1 or 2 or 7, wherein said arm of the rocker, which is attached to the extension spring, is bent in a direction toward the rocker support relative to the remainder of the rocker.

9. Switch according to claim 8, wherein a contact of the contact tongue, as well as the normally closed contact and normally open contact, are shifted laterally relative to an axis of extension of the extension spring.

10. Switch according to claim 1 or 2, wherein a contact of the contact tongue, as well as the normally closed contact and normally open contact, are shifted laterally relative to an axis of extension of the extension spring.

11. Switch according to claim 9, wherein said contact of the contact tongue is mounted laterally next to a point of attachment of the extension spring on the contact tongue.

12. Switch according to claim 10, wherein said contact of the contact tongue is mounted laterally next to a point of attachment of the extension spring on the contact tongue.

13. Switch according to claim 1 or 2, wherein the working piston is located laterally off-center relative to the central longitudinal axis of the housing.

14. Switch according to claim 1 or 2, wherein said end of the working piston, in an area opposite the rocker support, is stepped or recessed enabling it to pass a piston stop formed by a free end of the rocker support, and means for preventing rotation of said working piston is provided.

15. Switch according to claim 14, wherein said means for preventing rotation comprises a transverse groove in said end of the working piston, whose width roughly corresponds to the width of said one end of the rocker, said one end projecting into the transverse groove.

16. Switch according to claim 1 or 2, wherein said guide part is provided with a slot which runs in the plane of movement of the rocker for providing unimpeded passage of one end of the rocker to the axial bore.

17. Switch according to claim 1 or 2 or 7, wherein the housing comprises a first cylindrical part which receives the microswitch element, a middle part, located adjacent said first part on one end, having an external tool-application area and internally receiving said guide part and working piston, and an end part adjacent a second end of said middle part, said end part having a diameter, both internally and externally, that is smaller than the first and middle parts, being provided with an external thread and containing, internally, said recess for the substance which expands when heated.

18. Switch according to claim 17, wherein the diameter of the working piston is approximately two-thirds the diameter of said recess for the substance which expands when heated.

19. Switch according to claim 17, wherein said external tool-application area is an external hexagon.

20. Switch according to claim 1 or 2 or 7, wherein said piston is formed of plastic, and said substance that expands when heated is a wax.

* * * * *